US008986502B2

(12) United States Patent
Hölter et al.

(10) Patent No.: US 8,986,502 B2
(45) Date of Patent: Mar. 24, 2015

(54) PHOTODEGRADABLE PAPER AND ITS USE

(75) Inventors: Dirk Hölter, Emmendingen (DE); Wolfgang Koppe, Merzhausen (DE)

(73) Assignee: Solvay Acetow GmbH, Freiburg im Breisgau (DE)

( * ) Notice: Subject to any disclaimer, the term of this patent is extended or adjusted under 35 U.S.C. 154(b) by 0 days.

(21) Appl. No.: 13/578,749

(22) PCT Filed: Feb. 10, 2011

(86) PCT No.: PCT/EP2011/051937

§ 371 (c)(1),
(2), (4) Date: Oct. 25, 2012

(87) PCT Pub. No.: WO2011/098510

PCT Pub. Date: Aug. 18, 2011

(65) Prior Publication Data

US 2013/0199742 A1 Aug. 8, 2013

(30) Foreign Application Priority Data

Feb. 12, 2010 (EP) ..... 10153510

(51) Int. Cl.

| | |
|---|---|
| ***D21H 21/00*** | (2006.01) |
| ***D21H 17/63*** | (2006.01) |
| ***B01J 21/00*** | (2006.01) |
| ***D21H 17/69*** | (2006.01) |
| *D21H 19/38* | (2006.01) |
| *D21H 21/52* | (2006.01) |
| *D21H 27/10* | (2006.01) |

(52) U.S. Cl.

CPC ..... *D21H 17/63* (2013.01); *D21H 17/69* (2013.01); *D21H 19/38* (2013.01); *D21H 21/52* (2013.01); *D21H 27/10* (2013.01)

USPC ..... 162/181.5; 162/139; 162/158; 162/181.1; 162/181.4; 106/474; 502/182; 502/350

(58) Field of Classification Search

USPC ..... 162/139, 158, 1, 181.4–181.5; 131/58–60, 95, 111–116; 428/292.1, 428/402, 403, 513, 545, 546, 565, 688, 689, 428/702; 106/400, 401, 436, 472, 474; 502/100, 182, 349, 350; 420/417

See application file for complete search history.

(56) References Cited

U.S. PATENT DOCUMENTS

| | | | | |
|---|---|---|---|---|
| 2,206,278 | A | 7/1940 | Dreyfus | |
| 3,961,975 | A | 6/1976 | Zannucci et al. | |
| 4,073,764 | A | 2/1978 | Hemmerich et al. | |
| 5,312,484 | A | 5/1994 | Kaliski | |
| 5,491,024 | A | 2/1996 | Brodof et al. | |
| 5,626,719 | A * | 5/1997 | Tansley et al. | 162/158 |
| 5,647,383 | A | 7/1997 | Brodof et al. | |
| 5,817,427 | A | 10/1998 | Ishida et al. | |
| 6,776,168 | B1 | 8/2004 | Teufel et al. | |
| 6,964,726 | B2 * | 11/2005 | Chen et al. | 162/134 |
| 7,078,102 | B2 * | 7/2006 | Robertson | 428/424.2 |
| 7,354,624 | B2 * | 4/2008 | Millero et al. | 427/387 |
| 7,510,763 | B2 * | 3/2009 | Gueneau et al. | 428/307.7 |
| 7,524,793 | B2 * | 4/2009 | Orth-Gerber et al. | 502/350 |
| 7,959,980 | B2 * | 6/2011 | Nakajima et al. | 427/387 |
| 2005/0226761 | A1 * | 10/2005 | Orth-Gerber et al. | 420/417 |
| 2007/0181038 | A1 * | 8/2007 | Sabesan et al. | 106/501.1 |
| 2007/0215005 | A1 | 9/2007 | Nicolai et al. | |
| 2008/0223536 | A1 | 9/2008 | Van Der Horst | |
| 2008/0260626 | A1 * | 10/2008 | Bloss et al. | 423/610 |
| 2010/0022383 | A1 * | 1/2010 | Kuntz et al. | 502/84 |
| 2011/0143923 | A1 * | 6/2011 | Bette et al. | 502/159 |

FOREIGN PATENT DOCUMENTS

| | | | |
|---|---|---|---|
| CA | 1073581 | A | 3/1980 |
| DE | 2436260 | B1 | 4/1975 |
| EP | 0716117 | A1 | 6/1996 |
| EP | 1925644 | A2 | 5/2008 |
| GB | 780749 | | 8/1957 |
| JP | 8-173763 | A | 7/1996 |
| JP | 8-173805 | A | 7/1996 |
| WO | 93/24685 | A1 | 12/1993 |
| WO | 97/02948 | A1 | 1/1997 |
| WO | 9729655 | | 8/1997 |
| WO | 01/86067 | A1 | 11/2001 |
| WO | 2006/133247 | A2 | 12/2006 |
| WO | 2007/002896 | A2 | 1/2007 |

OTHER PUBLICATIONS

Smook, Gary A., Handbook for Pulp and Paper Technologists, 2nd ed, Angus Wilde Publications, 1992, pp. 3-4.*

"Technical Data for Carbon", Wolfram Research, Inc., 4 pages, [online], retrieved from the Internet [retrieved Aug. 24, 2013], URL:http://periodictable.com/Elements/006/data.html>.*

Sivakumar et al, "Sol-gel synthesis of nanosized anatase from titanyl sulfate", Materials Letters 57 (2002) pp. 330-335, [online], retrieved from the Internet [retrieved Aug. 24, 2013], URL: http://ac.els-cdn.com/S0167577X02007863/1-s2.0-S0167577X02007863-main.pdf?_tid=71305ada-0cec-11e3-a648-00000aacb35f&acdnat=1377369720_J2b0e4e8f6901e65ff0a9ad15d351.*

Definition of grid in Oxford dictionary, 2 pages, [online], no date, retrieved from the Internet [retrieved Jun. 26, 2014], <URL:http://www.oxforddictionaries.com/us/definition/american_english/grid.>.*

Jokio, Papermaking Science and Technology, Book 10: Papermaking Part 3, Finishing, Fapet Oy, Finland, 1999, pp. 14-17.*

Smook, Gary A., Handbook for Pulp and Paper Technologists, 2nd ed, Angus Wilde Publications, 1992, p. 287.*

International Search Report issued on Apr. 6, 2011, by the European Patent Office as the International Searching Authority in International Patent Application No. PCT/EP2011/051937.

Written Opinion issued on Aug. 14, 2012, by the European Patent Office as the International Searching Authority in International Patent Application No. PCT/EP2011/051937.

Sakthivel et al, "Daylight Photocatalysis by Carbon-Modified Titanium Dioxide," Angew. Chem. Int. Ed., 2003, pp. 4908-4911, vol. 42.

Cassie, A. B. D.; Baxter, S. (1944) "Wettability of porous surfaces" Transactions of the Faraday Society, 40: 546.

Howells, R. D. (2009) "Waterproofing and Water and Oil Repellency" Kirk-Othmer Encyclopedia of Chemical Technology, 1-22.

* cited by examiner

*Primary Examiner* — Dennis Cordray

(57) ABSTRACT

A photodegradable paper including cellulose fibers and, if applicable, fillers, additives and/or other kind of fibers is described. Also described, is a paper particularly in the field of packaging, tissue papers or cigarettes.

18 Claims, No Drawings

PHOTODEGRADABLE PAPER AND ITS USE

CROSS-REFERENCE TO PRIOR APPLICATIONS

This application is a National Stage of PCT/EP2011/051937, filed Feb. 10, 2011, and designating the United States (published in English on Aug. 18, 2011, as WO 2011/098510 A1; the title and abstract were also published in English), which claims priority of EP 10153510.2, filed Feb. 12, 2010, each hereby expressly incorporated by reference in its entirety and each assigned to the assignee hereof.

The invention relates to a photodegradable paper containing cellulosic fibers and, if applicable, fillers, additives and/or other kind of fibers. This invention further relates to the use of such a paper particularly in the field of packaging, tissue papers or cigarettes.

Normally, paper products are recycled after use or brought to a waste disposal system. But there are also papers, which get into the environment, predominantly the food packaging, cigarette papers or tissue papers.

Paper products, which go or can go into the environment at the end of their life cycle, should be rapidly degraded, in order to limit the damage on the environment. In some applications, e.g. cigarette filter wrappings, the degradation of the paper is the prerequisite to start the degradation of enclosed materials.

Generally, papers consisting mainly of cellulose fibers are recognized as biodegradable. But depending on the environmental conditions or on the paper finish, the degradation can take a long time and in this case the paper contributes significantly to environmental pollution. This is especially the case, if the paper lies on a surface with insufficient conditions for the development of microorganisms, necessary for the biodegradation of the cellulose material, and if there is a lack of water or if the paper contains a finish preventing it to disintegrate in contact with water. Under these conditions an additional mechanism is necessary for a sufficient degradation of the material. In particular photo catalytic degradation by the exposure to light can be relevant in these cases. The photo catalytic degradation can be the exclusive mechanism leading to the complete degradation of the material, but it can also support other degradation mechanisms, such as biodegradation.

It is well known, that titanium dioxide, especially in form of anatase, can break down organic materials by photo catalytic reaction. Anatase absorbs light in the UV range of the light spectra. This energy excites electrons resulting in the transformation of water and oxygen into radicals which attack organic materials. This degradation of materials generally impairs their normal function. Therefore, much work was done on the stabilization of titanium dioxide containing materials. Examples of stabilization in plastic materials can be found in U.S. Pat. No. 2,206,278, GB 780,749 and U.S. Pat. No. 3,961,975.

Although photo degradation is not considered as a serious problem for common paper applications compared to other deterioration and degradation mechanisms of paper, there are works dealing with photo degradation or photo degradation accelerated by pigments, e.g. zinc oxide or titanium dioxide (U.S. Congress, Office of Technology Assessment, Book Preservation Technologies, OTA-0-375, Washington, D.C.: U.S. Government Printing Office, May 1988; L. Campanella et al, *Ann. Chim.,* 95, 2005, 727-740). Titanium dioxide is used in paper industry for special papers as filler and as coating pigment with high brightness and opacity (Ullmann's Encyclopedia of Industrial Chemistry, $6^{th}$ ed., 2003).

During the last years titanium dioxide has got more into the focus of the development of air purification systems with paper as pigment carrier (e.g. in form of wall papers). In those cases the objective is to destroy hazardous or odorous substances in the air by photo degradation catalyzed by titanium dioxide, but to maintain the paper carrier in its entirety (T. Tanaziki et al., *Journal of Health science,* 53, 2007, 514-519; JP 08173805; JP 08173763). U.S. Pat. No. 5,817,427 is concerned with a titanium dioxide containing paper used as a deodorizing element. Activated by light, many hazardous organic substances including malodorous substances are decomposed by oxidation. But it was also observed that the applied ultra fine titanium dioxide, besides the targeted substances, can also oxidize and decompose the paper matrix, which therefore must be protected.

In special applications, not-stabilized titanium dioxides were deliberately incorporated into plastics to increase the degradation of the material. The titanium dioxide was used in its anatase form, sometimes in combination with photo-degradation accelerating additives.

DE 24 36 260 C1 describes the use of titanium dioxide pigments with small particle diameters for targeted degradation of plastic compounds by the influence of weather and/or light. In CA 1073581 the application of titanium dioxide particles for photo catalytic degradation of polyolefins was disclosed.

WO-A-93/24/24685, EP 716 117 A1, U.S. Pat. No. 5,491,024 as well as U.S. Pat. No. 5,647,383 are dealing with accelerated photo catalytic degradation of cellulose esters.

The object of the present invention is to provide a paper, which shows a significantly enhanced photo degradation under environmental conditions. Furthermore the invention is directed to the use of this photodegradable paper particularly when the paper is not recycled: this concerns especially certain packaging, tissue papers (as for instance paper towel, handkerchief etc.), or papers used in the production of cigarettes (cigarette paper, plug wrap, tipping).

At this end, the invention proposes a paper, in which a carbon modified titanium dioxide, which is photo catalytically active, is incorporated.

The introduction of a carbon modified titanium dioxide in the paper resulted in an unexpected high acceleration of the photo degradation of the paper both in UV-range and in visible range of the light spectra.

The term "carbon modified" means "modified by elemental carbon". The scientific literature describes this carbon modification, for instance in the following publications: S. Sakthivel, H. Kisch, *Angew. Chem., Int. Ed.* 2003, 42, 4908-4911; K. S. Raja et al, *J. Power Sources* 2006, 161, 1450-1457; C. Xu et al., *Appl. Catal., B* 2006, 64, 312-317; Y. Li et al., *Chem. Phys. Lett.* 2005, 404, 25-29; M. Janus et al., *Appl. Catal., B* 2006, 63, 272-276). Normally, this modification is done by carbonization of an organic substance in contact with the material or with precursors of the material, which is to be modified but also by oxidation of metal carbides. Depending on the production process and the material which is modified with carbon, the carbon can be found in the final product in form of larger structures (e.g. layers, clusters) or in form of single carbon atoms. The carbon can be located within the material and/or on its surface.

The titanium dioxide according to the present invention is carbon modified in the whole volume or at its surface. Preferably, a carbon modified titanium dioxide is used, whose surface is carbon modified. By the modification the band gap of the semiconductor titanium dioxide is reduced, and in comparison to not-modified titanium dioxide light of longer wavelength can also be used for the excitement of a valence band electron so that the photo catalytic properties are activated.

The crystal structure of the titanium dioxide of the invention can be of the rutile type or of the anatase type. Preferably it is of the anatase type.

Advantageously the crystallite size of the carbon modified titanium dioxide is optimized, preferably between 5 and 150 nm, especially between 7 and 25 nm. In a particular case, it can be advantageous and even necessary to mill a commercially available carbon modified titanium dioxide to reduce the size of the agglomerates. Advantageously the carbon modified titanium dioxide has a density (ISO 787, part 10) of 3.0 to 5.0 g/cm$^3$, especially 3.5 to 4.2 g/cm$^3$. The specific surface of the carbon modified titanium dioxide is preferably larger than 100 m$^2$/g, especially larger than 250 m$^2$/g. It is especially advantageous that the carbon modified titanium dioxide presents, in contrast to not-modified titanium dioxide, a significant light absorption in the range of $\lambda$>=400 nm.

There are no special limitations for the carbon content of the carbon modified titanium dioxide. Preferably the amount of carbon is in the range of 0.05 to 5 wt %, especially from 0.3 to 1.5 wt %.

Besides functionality, there are no special limitations for the content of carbon modified titanium dioxide within the paper. Preferably the content of carbon modified titanium dioxide in the paper is in the range of 0.5 to 40 wt %, especially 2 to 25 wt %.

If needed, besides the carbon modified titanium oxide, other photo degradation accelerators may be added in the paper. As a photo degradation accelerator, for example benzoin; benzoin alkyl ether; benzophenone and its derivatives, such as 4,4'-bis(dimethylamino)benzophenone; acetophenone, such as alpha-diethoxyacetophenone and derivatives, can be cited.

The nature of the paper material according to the present invention, depends on the intended application. The paper can be based on usual fibers, whose origin is for instance pulp from wood or other lignocelluloses, mechanical pulp, waste paper, fiber crops (e.g. cotton, flax, hemp, sisal) or mixtures of two or more of them. The paper can also contain fibers of other materials, e.g. man made fibers like PA, PET, PP, PE, PVA, PTFE, PU, PVC, aramides, PPS or viscose. One or more of usual additives can be added besides the carbon modified titanium dioxide, e.g. fillers (e.g. kaolin, calcium carbonate, talc, gypsum), strength additives and binders (e.g. poly(ethylene imines), PA, urea- or formaldehyde condensates, starches and their derivatives, plant gums, alginate, cellulose derivatives, casein, gelatin, PVA, PVP, acrylic resin), sizing agents (e.g. rosin size, dimeric alkylketenes, aluminium sulfate), dyes, pigments (e.g. not carbon-modified titanium dioxide, iron oxide), optical brighteners, chemicals for specialty papers (e.g. flame retardants, corrosion inhibitors, antioxydants). Some process aids can be used for the production of paper, like retention aids (e.g. poly(ethylene imine), polyacrylamide, cationic starches, carboxymethylcelluloses), defoamers (e.g. mixtures of higher alcohols, salts of fatty acids, water-emulsible phosphate esters), biocides, dispersing agents, complexing agents (e.g. EDTA, DTPA, HEEDTA, oxalic acid salts, citric acid salts), precipitation and fixing agents, drainage aids, additives for waste paper processing and deinking. The additives are used in amounts advantageous for the respective application. These additives are well known for a man skilled in the art.

The paper can also contain a biodegradation promoter, such as cellulose chain splitting enzymes, phosphorus, nitrous and/or sulfurous additives.

There is no limitation concerning the introduction method of the modified titanium dioxide in the paper.

According to one embodiment of the invention, the modified titanium dioxide can be introduced in the fibers of the paper.

According to another embodiment of the invention, which is preferred, the titanium dioxide is directly introduced in the paper during its preparation.

In this case, in contrast to photodegradable polymers, the titanium dioxide added to paper is not incorporated within a fiber but distributed between the fibers and the weakening of the fiber structure obviously occurs by photo catalytic reaction at the contact points.

The production of paper according to the present invention is not limited to any process. Any suitable production process known in the art can be applied.

The paper can also be coated, printed or perforated. The coat or the printing ink can also contain the carbon modified titanium dioxide of the invention.

According to a specific embodiment of the invention, when the paper of the invention is used as a paper of cigarette, the filter material of the cigarette preferably also contains the carbon modified titanium dioxide of the invention.

Other details or advantages of the invention will appear more clearly in light of the examples given below.

EXAMPLES

A slurry of the titanium dioxide was prepared by dispersion in water via ultrasonic sound and setting of the pH to 8 by addition of NaOH.

16.8 g refined birch wood sulfate pulp was watered for 15 h in 250 ml tap water. This mixture was transferred into a disintegrator, filled up to 2 l with tap water and disintegrated for 2 min at 1500 rpm. This suspension was transferred into a beaker, filled up to 10 l and homogenized for 15 min.

The titanium dioxide slurry was added to 1 l of the resulting wood pulp suspension during stirring with 600 rpm and, subsequently, the mixture was neutralized with 0.5 M sulfuric acid.

The paper sheets were prepared on a Rapid-Köthen sheet former and afterwards dried for 3 min at 93° C. in vacuo (water jet pump) on the sheet former and subsequently for 2 h at 105° C. in a drying cabinet.

The resulting example paper sheets contained 15 wt % of the titanium dioxide

The slurries were prepared using different titanium dioxides:

TABLE 1

| Example | Titanium dioxide type | Oil absorption value (ISO 787/5) | Crystallite size | BET surface [m$^2$/g] | Carbon content [wt %] |
|---|---|---|---|---|---|
| A | anatas pigment (uncoated) | 20 | ~0.3 μm | 9 | — |
| B | ultrafine anatas photocatalyst (uncoated) | ~50 | ~15 nm | >250 | — |
| C | ultrafine carbon doped anatas (surface doped) | ~50 | ~15 nm | >250 | 0.8 |

From the example paper sheets stripes of 150 mm length and 15 mm width were cut, and in each case an area of 20 mm length of these stripes irradiated at a wavelength of 365 nm (Vilber Lourmat UV irradiation system) with 40 Watt. The irradiation was performed for 6 and 12 h, respectively.

The irradiated stripes were stored according to DIN EN ISO 20187 at 23° C. and 50% relative humidity until constant weight. The paper thickness was measured according to DIN EN ISO 534, the specific mass according to DIN EN ISO 536.

The E-modulus was measured using a tensile tester.

The determined reductions of the E-moduli are summarized in Table 2.

TABLE 2

| Reduction [%] of E-modulus versus time of irradiation | | | |
|---|---|---|---|
| | 0 hours | 6 hours | 12 hours |
| Example A | 0 | 2 | 3 |
| Example B | 0 | 3 | 3 |
| Example C | 0 | 11 | 18 |

The invention claimed is:

1. A photodegradable paper comprising cellulosic fibers and, optionally, additives, wherein the photodegradable paper comprises a carbon modified titanium dioxide, wherein the carbon is located within and/or on the surface of the carbon-modified titanium dioxide, and the carbon-modified titanium dioxide is distributed between the fibers of the photodegradable paper; and wherein the carbon modified titanium dioxide has, in contrast to not-modified titanium dioxide, a significant light absorption in the range of $\lambda >= 400$ nm; and wherein the content of carbon modified titanium dioxide within the photodegradable paper is in the range of 0.5 wt % to 40 wt %.

2. The photodegradable paper as defined in claim 1, wherein the cellulosic fibers originate from a source selected from the group consisting of wood, lignocellulose, mechanical pulp, waste paper, fiber crop or a mixture of two or more of them.

3. The photodegradable paper as defined by claim 1, wherein the carbon modified titanium dioxide is carbon modified at its surface.

4. The photodegradable paper as defined by claim 1, wherein the carbon modified titanium dioxide has a crystallite size of 5 nm to 150 nm.

5. The photodegradable paper as defined by claim 1, wherein the carbon modified titanium dioxide has a density (ISO 787, part 10) of 3.0 g/cm$^3$ to 5.0 g/cm$^3$.

6. The photodegradable paper as defined by claim 1, wherein the carbon modified titanium dioxide has a specific surface (BET) greater than 100 m$^2$/g.

7. The photodegradable paper as defined by claim 1, wherein the carbon content of the carbon modified titanium dioxide is in the range of 0.05 wt % to 5 wt %.

8. The photodegradable paper as defined by claim 1, wherein the photodegradable paper is at least one part of a packaging material.

9. The photodegradable paper as defined by claim 1, wherein it is a paper tissue.

10. The photodegradable paper as defined by claim 4, wherein the carbon modified titanium dioxide has crystallite size of from 7 nm to 25 nm.

11. The photodegradable paper as defined by claim 4, wherein the carbon modified titanium dioxide has a density of 3.5 g/cm$^3$ to 4.2g/cm$^3$.

12. The photodegradable paper as defined by claim 6, wherein the carbon modified titanium dioxide has a specific surface (BET) greater than 250 m$^2$/g.

13. The photodegradable paper as defined by claim 7, wherein the carbon content of the carbon modified titanium dioxide is in the range of 0.3 wt % to 1.5 wt %.

14. The photodegradable paper as defined by claim 1, wherein the content of carbon modified titanium dioxide within the photodegradable paper is in the range of 2 wt % to 25 wt %

15. The photodegradable paper as defined by claim 8, wherein the packaging material is a food packaging material.

16. A cigarette comprising the photodegradable paper as defined by claim 1.

17. The cigarette as defined by claim 16, wherein the paper is a cigarette paper, a plug wrap and/or a tipping.

18. The cigarette as defined by claim 17, wherein the filter material of the cigarette also comprises a carbon modified titanium dioxide.

* * * * *